United States Patent [19]

Foyt

[11] Patent Number: 4,858,400

[45] Date of Patent: Aug. 22, 1989

[54] ADJUSTABLE SHUTTER

[76] Inventor: Douglas C. Foyt, 1412 W. Main, Blytheville, Ark. 72315

[21] Appl. No.: 198,556

[22] Filed: May 25, 1988

[51] Int. Cl.[4] ..... E06B 7/08

[52] U.S. Cl. ..... 52/98; 52/473

[58] Field of Search ..... 52/98, 473

[56] References Cited

U.S. PATENT DOCUMENTS

| | | | |
|---|---|---|---|
| 2,210,516 | 8/1940 | Wheeler . | |
| 2,496,921 | 2/1950 | Vicksell, Sr. . | |
| 2,580,268 | 12/1951 | Achler et al. . | |
| 3,120,883 | 2/1964 | Greiling | 52/473 |
| 3,191,242 | 6/1965 | Rauen | 52/473 |
| 3,455,079 | 7/1969 | Frederick | 52/473 |
| 3,932,959 | 1/1976 | Jansons et al. . | |
| 4,192,369 | 3/1980 | Taylor . | |
| 4,251,966 | 2/1981 | Foltman | 52/473 |

*Primary Examiner*—John E. Murtagh

*Attorney, Agent, or Firm*—Fleit, Jacobson, Cohn, Price, Holman & Stern

[57] ABSTRACT

A multi-section shutter assembly constructed of plastic is provided and at least one section includes louver slats extending between the stiles thereof and connected therebetween in a manner enabling the opposite ends of one or more slats to be severed from the corresponding stiles and the stile ends are also severable from the remainder of the stiles, one pair of ends of the stiles being interconnected by an end mullion extending therebetween. The other section of the shutter includes stiles which may be lap engaged over the stiles of the one section and also includes an end mullion. By this construction, a purchased shutter may be shortened as desired and may be purchased in various different colors and styles from a relatively small inventory of different parts.

8 Claims, 2 Drawing Sheets

FIG. 1
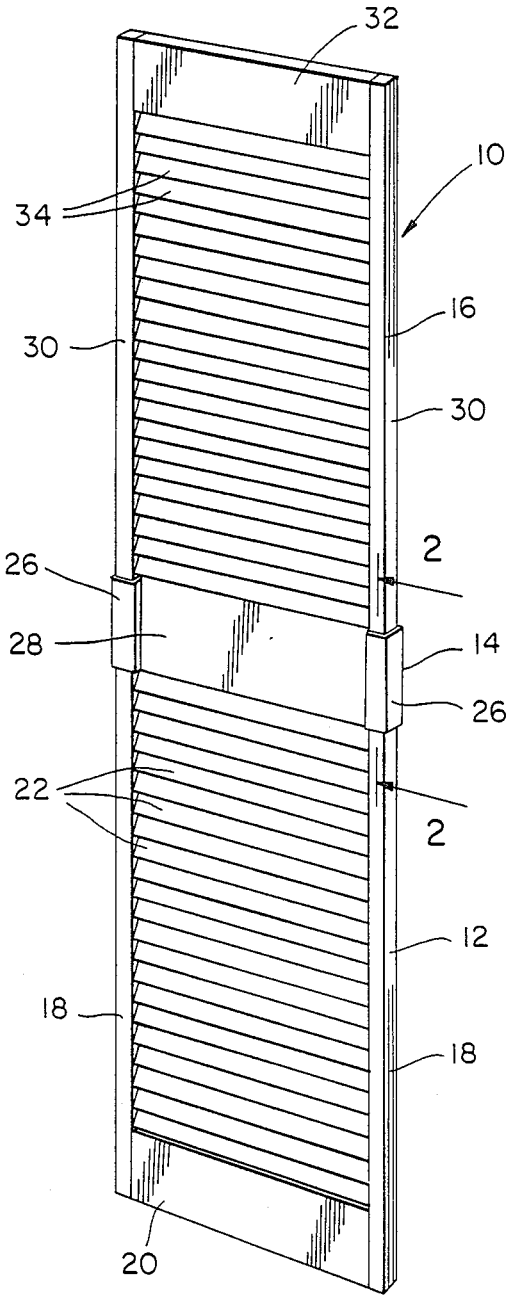
FIG. 2
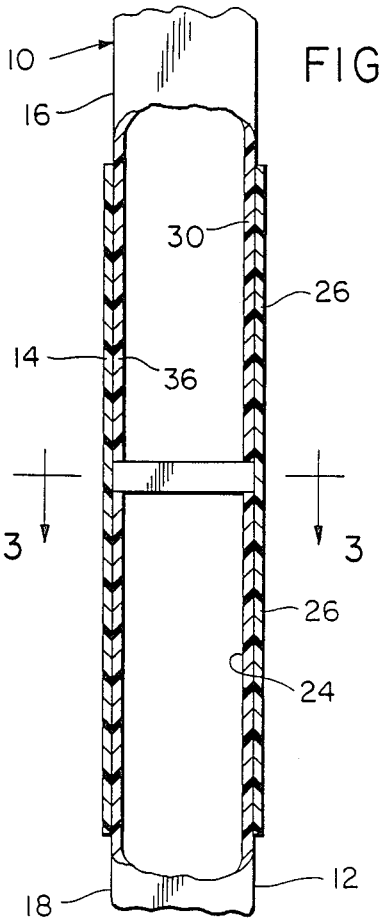
FIG. 3
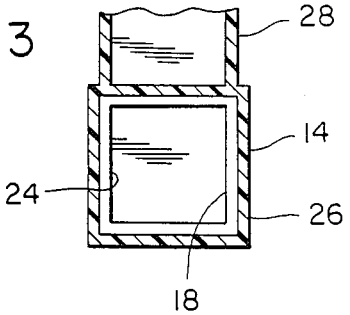
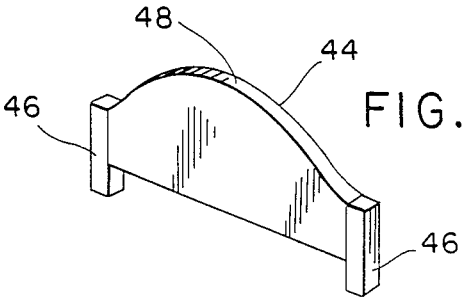
FIG. 8

ADJUSTABLE SHUTTER

BACKGROUND OF THE INVENTION

1. Field of the Invention

This invention relates to a shutter assembly constructed of two or three vertically spaced components with each component including a transverse mullion and at least one of the components also including opposite side stiles between which vertically spaced louver slats extend and are secured, the opposite ends of the louver slats being anchored relative to the corresponding stiles in a manner such that the ends of the slats may be readily severed from the associated stiles. In addition, at least the stiles of the louver slat equipped component may be shortened, as desired, through the utilization of a saw or other cutting implement and the stiles of vertically adjacent components are removably lap engaged with each other. By this construction the design and length of a shutter may be varied to a considerable extent.

2. Description of Related Art

Various different forms of adjustable dimension shutters and other louvered structures heretofore have been provided such as those disclosed in U.S. Pat. Nos. 2,210,516, 2,496,921, 2,580,268, 3,120,833, 3,191,242, 3,932,959, 4,192,369 and 4,251,966. However, these previously known adjustable dimension shutters and other louvered constructions do not include the overall combination of structural features incorporated in the instant invention whereby the length and design of a purchased shutter may be varied as desired, within limits, by the purchaser thereof.

SUMMARY OF THE INVENTION

Many homeowners find it necessary to replace original wooden shutters which have deteriorated. Recently, replacement shutters (as well as shutters for use in new home construction) have been manufactured and constructed of plastic. Plastic shutters have a greater life expectancy than wooden shutters and are less expensive to produce and market.

On the other hand, plastic shutters usually are manufactured in various colors, sizes and designs, thereby making it very difficult for a retail outlet to maintain an inventory to suit the needs of even a small majority of possible customers. Accordingly, a need exists for a new concept of shutter which will enable a retail outlet to substantially reduce the required amount of inventory to satisfy the needs of at least a small majority of its potential customers.

To this end, the shutter of the instant invention is adjustable in length and in style and, accordingly, two of the major variances in shutter constructions may be compensated for by a purchaser either subsequent to purchase of a plurality of shutters or during the purchase of the shutter construction and a retailer need only concern himself with inventories of color and width.

The main object of this invention is to provide a multi-sectional shutter construction which may be varied in length by the ultimate purchaser with relative ease and which may be varied in style at the time of purchase from a relatively small inventory of different style components.

Another object of this invention is to provide an improved shutter construction in accordance with the preceding object and wherein cutting operations on one or more components of the shutter construction to vary the size thereof may be readily carried out.

Still another object of this invention is to provide an improved shutter construction of the multi-component type and wherein various different methods of attaching the shutter construction to an existing building structure may be utilized.

A final object of this invention to be specifically enumerated herein is to provide an improved shutter construction in accordance with the preceding objects and which will conform to conventional forms of manufacture, be of simple construction and easy to install so as to provide a device that will be economically feasible, long-lasting and relatively trouble free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is perspective view of a shutter constructed in accordance with the present invention.

FIG. 2 is an enlarged, fragmentary, vertical, sectional view taken substantially upon the plane indicated by the section line 2—2 of FIG. 1.

FIG. 3 is a horizontal, sectional view taken substantially upon the plane indicated by the section line 3—3 of FIG. 2.

FIG. 8 is a perspective view of an abbreviated upper mullion component of the instant invention which may be used in conjunction with only the lower component of the three components illustrated in FIG. 4 to provide a different style shutter of a shorter length.

DESCRIPTION OF THE PREFERRED EMBODIMENT

Figure 4:
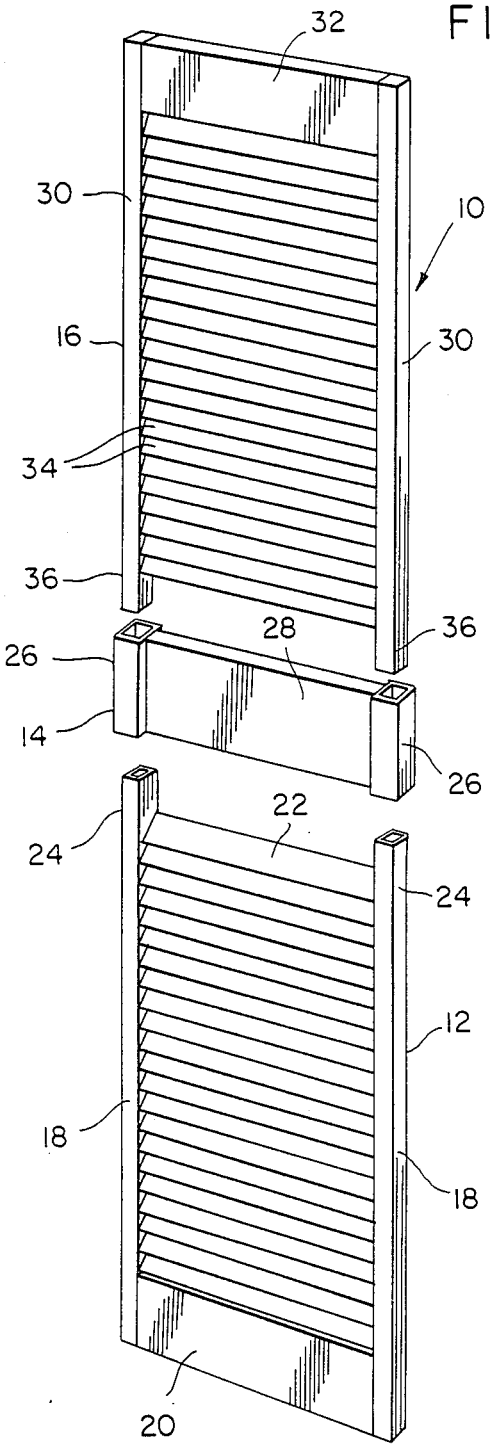
FIG. 4 is an exploded, perspective view of the shutter illustrated in FIG. 1 and illustrating the individual components thereof.

Referring now more specifically to the drawings, the numeral 10 generally designates an adjustable length shutter assembly constructed in accordance with the present invention. The shutter assembly 10 includes three vertically spaced shutter sections including a first lower section 12, a second or intermediate section 14 and a third upper section 16. The lower section 12 includes a pair of opposite side, elongated and upstanding parallel stiles 18 interconnected at their lower ends by a first lower mullion 20 and a plurality of vertically spaced transversely extending louver slats 22 extend between and interconnect the stiles 18 above the mullion 20.

From FIG. 4 it may be seen that the stiles 18 include upper end portions 24 which project above the uppermost louver slat 22. Further, it may be seen that the stiles 18 are tubular, the lower first mullion 20 also being of tubular construction.

The second or intermediate section 14 includes a pair of parallel upstanding opposite side stiles 26 which are also tubular and a second mullion 28 extends between and interconnects the stiles 26, the stiles 26 and mullion 28 being of tubular construction.

The third upper section 16 includes a pair of opposite side stiles 30 corresponding to the stiles 18, a third upper mullion 32 extending between the stiles 30 and a plurality of horizontal transverse louver slats 34 extending between and connected to the stiles 30. The stiles 30 and mullion 32 are also tubular and the lower ends of the stiles 30 include lower end portions 36 which project below the lowermost louver slat 34. It may be noted that the upper section 16 may comprise a duplicate of the lower section 12.

The tubular stiles 26 are of transverse inside dimensions slightly greater than the transverse outside dimensions of the end portions 24 and 36 and the latter may be snugly telescoped into the tubular stiles 26 in order to assemble the sections 12, 14 and 16 relative to each other and to form the shutter assembly 10 illustrated in FIG. 1.

Figure 6:
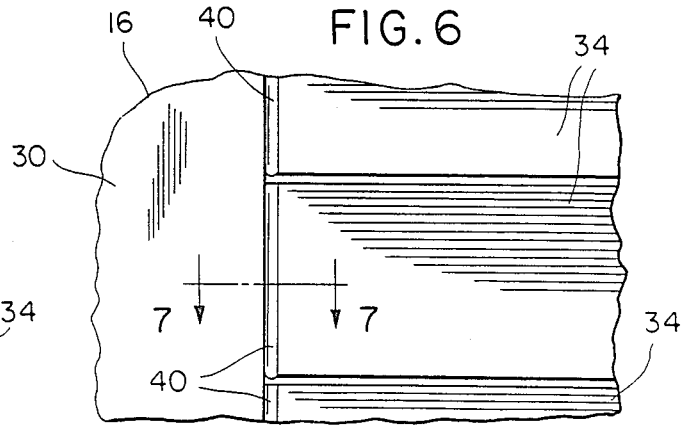
FIG. 6 is a fragmentary, enlarged, elevational view of a left marginal portion of the upper section of the shutter illustrated in FIG. 5.
Figure 7:
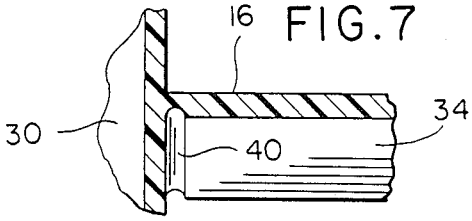
FIG. 7 is a fragmentary, enlarged, horizontal, sectional view taken substantially upon the plane indicated by the section 6—6 of FIG. 7 and illustrating the grooved end of one of the louver slats along which that louver slat may be severed from the adjacent stile.

With attention now invited more specifically to FIGS. 6 and 7, it may be seen that the opposite ends of the louver slats 34 are grooved at their opposite ends as at 40.

If the ultimate shutter assembly, after being purchased, is to be the equivalent of the vertical height of four louver slats shorter than that illustrated in FIG. 1, a simple fine toothed saw may be used to remove two of the louver slats 34 from the lower section 12 as well as the upper section 16. Then, an equal length of each of the end portions 24 and 36 also is removed through the utilization of a fine toothed saw and the sections 12, 14 and 16 are joined by telescoping the four shortened end portions 24 and 36 into the lower and upper ends, respectively, of the tubular stiles 26. After assembly, the shutter assembly 10 may be installed in a conventional manner.

It is to be noted that the shutter sections 12, 14 and 16 may be manufactured in approximately five different colors and perhaps in two different widths. Thus, for a complete range in colors, widths and lengths there need be only ten of each of the sections 12, 14 and 16 maintained in inventory, all possibilities of different lengths of shutters being taken care of by the ultimate purchaser of the shutter construction 10. In addition, a difference in style of the shutter assembly may be made available upon maintaining ten different upper sections such as that indicated at 44 in FIG. 8. The section 44 may be made in two different widths and in five different colors. The section 44 includes a pair of opposite side stiles 46 and an upper transverse mullion 48. If a vertically short shutter of a different style is desired, the section 44 may be used in conjunction with only the section 12, the stiles 46 having inside transverse dimensions only slightly greater than the external transverse dimensions of the stiles 18 Of course, the section 44 may include a stile similar to the stile 32.

Figure 5:
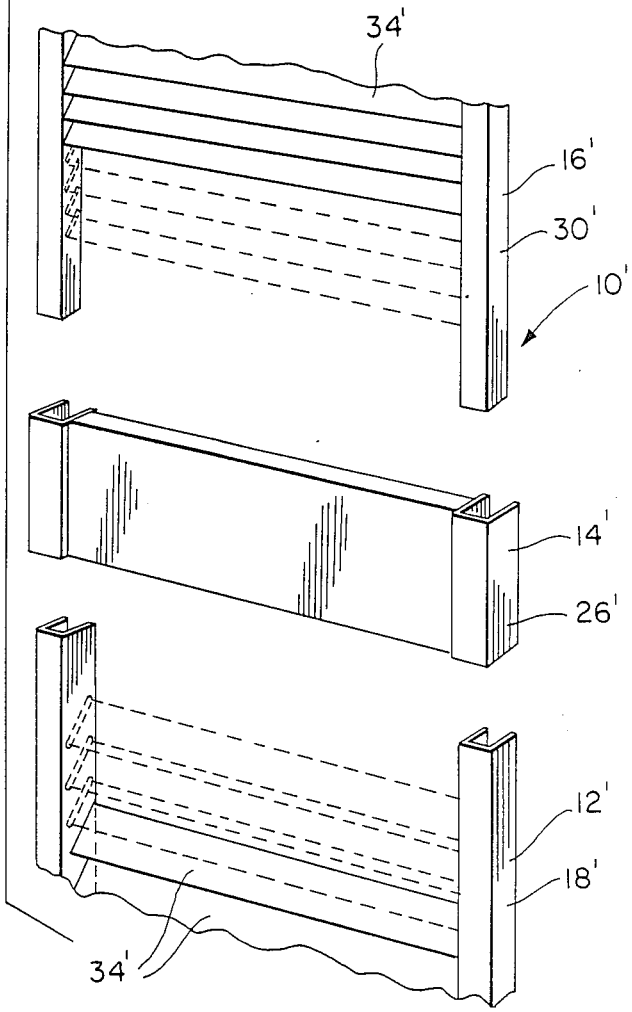
FIG. 5 is a fragmentary, perspective view of a shutter construction constructed in accordance with the present invention and similar to that illustrated in FIG. 4, but with the opposite side stile sections of the components being channel shaped as opposed to tubular.

With attention now invited more specifically to FIG. 5 of the drawings, there may be seen a modified form of shutter assembly referred to in general by the reference numeral 10'. The shutter assembly 10' includes lower, intermediate and upper sections 12', 14' and 16' corresponding to the sections 12, 14 and 16, but the stiles 18', 26' and 30' thereof are channel shaped rather than tubular. Accordingly, while the stiles 26 telescopingly receive the adjacent ends of the stiles 18 and 36 therein, the stiles 26 may be laterally lap engaged with the adjacent ends of the stiles 18 and 30 from the front sides thereof.

It is pointed out, however, that the sections 12' and 16' may not be the same, inasmuch as the angulation of the louver slats 34' thereof would be reversed if the sections 12' and 16' were inverted.

It is to be noted that the shutter assemblies 10 and 10' conveniently may be constructed of an ultraviolet light resistant plastic and be colored substantially any color, although it is believed that generally five basic colors are sufficient for a large proportion of the buying public. Further, the channel shaped sections 12', 14' and 16' may be equipped with mounting fastener retaining means (not shown) for facilitating mounting of the shutter assembly 10' and substantially any conventional method of shutter mounting may be used in conjunction with the shutter construction 10.

In the event one part of the shutter construction 10 or one part of the shutter construction 10' is damaged and needs to be replaced, only the one replacement section need be purchased and installed. Also, it is pointed out that the intermediate sections 14 may include louver slats as opposed to a center mullion, thereby enabling the assembly of a long, full louvered shutter.

It is proposed that the slats 22 and 34 will have an effective vertical height of 1", thereby enabling the length of the ultimate shutter constructed to be varied in increments of 1". Of course, the mullion 32 of the upper section 16 also could be shaped in a manner similar to the mullion 48 of the section 44, and other shapes also may be provided.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. An adjustable length shutter assembly including at least first and second vertically spaced shutter sections, one of said sections including a first pair of opposite side, elongated and generally parallel upright stiles permanently interconnected at one pair of corresponding ends by a first mullion extending and connected therebetween, said one section also including a plurality of elongated, transverse and vertically laterally spaced slats integrally formed with and extending between said stiles and spaced therealong from said first mullion toward the other pair of corresponding ends of said stiles, the other of said sections including a second pair of opposite side, elongated and generally parallel vertical stiles permanently interconnected at one pair of corresponding ends by a second mullion extending and connected therebetween, the other pair of corresponding ends of said second pair of stiles and said other pair of ends of said first pair of stiles being relatively overlap engaged with each other with each pair of stiles forming a lengthwise continuation of the other pair of stiles and said second mullion laterally adjacent the slat furthest from said first mullion, at least the slats adjacent said other pair of ends of said first pair of stiles being joined, at their opposite ends, to the corresponding stiles along visually ascertainable reduced material thickness zones extending transversely of the last mentioned slats and along which zones the last mentioned ends may be readily manually individually severed from said first pair of stiles and said other pair of corresponding ends of said first pair of stiles being severable form the remaining portions of said first pair of stiles to compensate for the number of slats severed at their opposite ends from said first pair of stiles.

2. The shutter of claim 1 including a third shutter section disposed on the end of said other section remote from said one section, said third section including a third pair of opposite side, elongated and vertical stiles permanently interconnected at one pair of corresponding ends by a third mullion extending and connected therebetween, said third section also including a plurality of elongated transverse slats integrally formed with and extending between said third pair of stiles and spaced therealong from said third mullion toward the other pair of corresponding ends of said third pair of stiles, said other pair of ends of said third pair of stiles and said one pair of ends of said second pair of stiles being relatively overlap engaged with each other with said third pair of stiles forming lengthwise continuations of said one pair of ends of said second pair of stiles, said shutter assembly including opposite end and center mullions comprising said first and third mullions and said second mullion, respectively.

3. The shutter assembly of claim 2 wherein at least the slats adjacent said other pair of ends of said third pair of stiles are each joined, at their opposite ends, to the corresponding stiles along visually ascertainaable reduced material thickness zones extending transversely of the last mentioned slats and along which zones the last mentioned ends may be readily manually individually severed, from said third pair of stiles and said other pair of ends of said third pair of stiles are severable from the remaining portions of said third pair of stiles to compensate for the number of slates severed at their opposite ends from said third pair of stiles.

4. The shutter assembly of claim 2 wherein said overlap engaged stile ends are telescopingly engaged.

5. The shutter assembly of claim 2 wherein said overlap engaged stile ends are channel shaped in transverse cross section and are laterally lap engaged with each other.

6. The shutter assembly of claim 1 wherein said other section comprises the uppermost section and said one section comprises the lowermost section.

7. The shutter assembly of claim 5 wherein said second pair of stiles are telescoped over the adjacent ends of said first and third pair of stiles.

8. The shutter assembly of claim 1 wherein said stiles, mullions and slats are constructed of plastic.

* * * * *